US011245218B2

(12) United States Patent
Demaratos et al.

(10) Patent No.: US 11,245,218 B2
(45) Date of Patent: Feb. 8, 2022

(54) METHOD FOR IMPROVING CLEARANCE AND CREEPAGE IN A HIGH VOLTAGE CONNECTOR ASSEMBLY USING A MALE TERMINAL POSITION ASSURANCE (TPA) DEVICE

(71) Applicant: J.S.T. CORPORATION, Farmington Hills, MI (US)

(72) Inventors: David Demaratos, Wixom, MI (US); Frank Holub, West Bloomfield, MI (US)

(73) Assignee: J.S.T. CORPORATION, Farmington Hills, MI (US)

( * ) Notice: Subject to any disclaimer, the term of this patent is extended or adjusted under 35 U.S.C. 154(b) by 0 days.

(21) Appl. No.: 16/854,563

(22) Filed: Apr. 21, 2020

(65) Prior Publication Data

US 2020/0274283 A1 Aug. 27, 2020

Related U.S. Application Data

(62) Division of application No. 16/389,928, filed on Apr. 20, 2019, now Pat. No. 10,923,847.

(Continued)

(51) Int. Cl.
*H01R 13/436* (2006.01)
*H01R 13/424* (2006.01)

(Continued)

(52) U.S. Cl.
CPC ..... *H01R 13/436* (2013.01); *H01R 13/424* (2013.01); *H01R 13/4362* (2013.01);

(Continued)

(58) Field of Classification Search
CPC ..... H01R 13/424; H01R 13/436; H01R 13/4362; H01R 13/502; H01R 13/629; H01R 13/639; H01R 43/20
See application file for complete search history.

(56) References Cited

U.S. PATENT DOCUMENTS 4,946,399 A 8/1990 Kawashima
5,516,308 A 5/1996 Yamanashi (Continued)

FOREIGN PATENT DOCUMENTS

DE 102014108283 A1 12/2015
WO 2018/215026 A1 11/2018

OTHER PUBLICATIONS

International Search Report of the International Searching Authority for International Application No. PCT/US2019/029536 dated Jul. 10, 2019 (2 sheets).

(Continued)

*Primary Examiner* — Oscar C Jimenez
(74) *Attorney, Agent, or Firm* — Kratz, Quintos & Hanson, LLP

(57) ABSTRACT

A method for improving clearance and creepage in a male high voltage connector assembly using a male terminal position assurance (TPA) device. The male high voltage connector assembly is highly suitable for high voltage electrical terminals, which are larger terminals. The method includes a step of allowing a clearance and creepage or electrical path to extend from at least a high voltage electrical terminal to a male outer housing of the high voltage connector assembly. When the TPA device is inserted and locked within a male inner housing of the high voltage connector assembly, the clearance and creepage or electrical path extends from the high voltage electrical terminal along at least a surface of the TPA device and to the male outer housing of the high voltage connector assembly. The male TPA device includes wing-like shape members with intermediate members that extend substantially and respectively downward from the wing-like shape members.

2 Claims, 4 Drawing Sheets

Related U.S. Application Data

(60) Provisional application No. 62/810,179, filed on Feb. 25, 2019.

(51) Int. Cl.
*H01R 43/20* (2006.01)
*H01R 13/502* (2006.01)
*H01R 13/629* (2006.01)
*H01R 13/639* (2006.01)

(52) U.S. Cl.
CPC ..... *H01R 13/502* (2013.01); *H01R 13/629* (2013.01); *H01R 13/639* (2013.01); *H01R 43/20* (2013.01)

(56) References Cited

U.S. PATENT DOCUMENTS

| | | | | |
|---|---|---|---|---|
| 5,518,334 | A | 5/1996 | Yagi | |
| 5,595,509 | A | 1/1997 | Fry | |
| 5,967,842 | A | 10/1999 | Okabe | |
| 6,083,014 | A | 7/2000 | Bogdan | |
| 6,155,888 | A | 12/2000 | Kurimoto | |
| 6,183,314 | B1 | 2/2001 | Wada | |
| 6,358,102 | B1 | 3/2002 | Fukamachi | |
| 7,165,995 | B2 | 1/2007 | Fukushima | |
| 7,614,910 | B2 | 11/2009 | Croteau | |
| 7,632,148 | B1 | 12/2009 | Kawamura | |
| 7,811,105 | B1 | 10/2010 | Tan Chin Yaw | |
| 10,892,579 | B2 * | 1/2021 | Demaratos | H01R 13/629 |
| 2004/0106325 | A1 | 6/2004 | Miyazaki | |
| 2005/0215122 | A1 | 9/2005 | Nishida | |
| 2007/0093131 | A1 | 4/2007 | Takahashi | |
| 2008/0119091 | A1 * | 5/2008 | Nishide | H01R 13/4362 439/733.1 |
| 2009/0130902 | A1 | 5/2009 | Hall | |
| 2010/0261364 | A1 | 10/2010 | Matsuoka | |
| 2010/0279555 | A1 | 11/2010 | Azad | |
| 2012/0214358 | A1 | 8/2012 | Takahashi | |
| 2013/0017719 | A1 | 1/2013 | Tanaka | |
| 2013/0023137 | A1 | 1/2013 | Glick | |
| 2014/0287631 | A1 | 9/2014 | Tashiro | |
| 2016/0329651 | A1 | 11/2016 | Yamaguchi | |
| 2017/0207577 | A1 | 7/2017 | Holub | |
| 2017/0338600 | A1 | 11/2017 | Tanaka | |
| 2018/0261946 | A1 | 9/2018 | Hori | |
| 2018/0316132 | A1 | 11/2018 | Holub | |
| 2020/0274275 | A1 * | 8/2020 | Kim | H01R 12/58 |

OTHER PUBLICATIONS

Written Opinion of the International Searching Authority for International Application No. PCT/US2019/029536 dated Jul. 10, 2019 (4 sheets).

Office Action of U.S. Appl. No. 16/370,069 dated Apr. 4, 2020.

Written Opinion of the International Searching Authority for International Application No. PCT/US2020/015929 dated Apr. 20, 2020 (6 sheets).

International Search Report for International Application No. PCT/US2020/015929 dated Apr. 20, 2020 (2 sheets).

International Preliminary Report on Patentability for International Application No. PCT/US2019/062861 dated Apr. 21, 2020 (12 sheets).

* cited by examiner

METHOD FOR IMPROVING CLEARANCE AND CREEPAGE IN A HIGH VOLTAGE CONNECTOR ASSEMBLY USING A MALE TERMINAL POSITION ASSURANCE (TPA) DEVICE

CROSS-REFERENCE TO RELATED APPLICATIONS

This patent application is a Divisional Application of U.S. patent application having U.S. Ser. No. 16/389,928 filed on Apr. 20, 2019, which claims priority to U.S. Provisional patent application having U.S. Ser. No. 62/810,179 filed Feb. 25, 2019, the entire contents of which are incorporated herein by reference in their entireties.

BACKGROUND OF THE INVENTION

Due to the high voltage that a high voltage connector assembly is required to meet and due to the design of traditional shielded automotive connectors, it is desired that clearance and creepage from at least a high voltage electrical terminal to an electrically conducting outer housing, to an electrical element/circuit, or to a traditional stamped metal shield for shielding be improved or increased.

SUMMARY OF THE INVENTION

This invention is directed to a method for improving clearance and creepage in a high voltage connector assembly using a male terminal position assurance (TPA) device. The high voltage connector assembly in this invention is highly suitable for high voltage electrical terminals, which are larger terminals. The male TPA device in this invention includes wing-like shape members with intermediate members that extend substantially and respectively downward from the wing-like shape members and into the male inner housing thereof. With the above-described characteristics of this invention, "creepage" (a measurement of the shortest path along the surface from any given circuit in a connector to any (usually adjacent) other circuit), and "clearance" (defined as, e.g., a measurement of the shortest electrical path from any exposed electrically conducting element in a given circuit of a connector to any other electrically conducting element in a different circuit in the same connector) are advantageously increased.

DETAILED DESCRIPTION OF THE PREFERRED EMBODIMENTS

Figure 1:
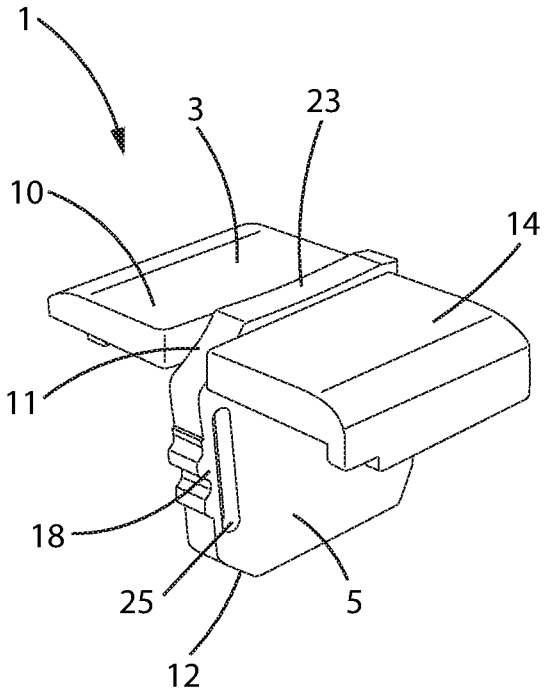
FIG. 1 is a front perspective view of a male terminal position assurance (TPA) device of this invention for use in a male high voltage connector assembly.

FIG. 1 illustrates a front perspective view of the male terminal position (TPA) device, generally referred to as reference numeral 1, of this invention. The male TPA device 1 includes an upper member 3 and a lower member 5. The upper member 3 has a substantially wing-like shape having sides 10, 14. The lower member 5 includes a flexible arm member 18 in a front portion thereof.

Figure 2:
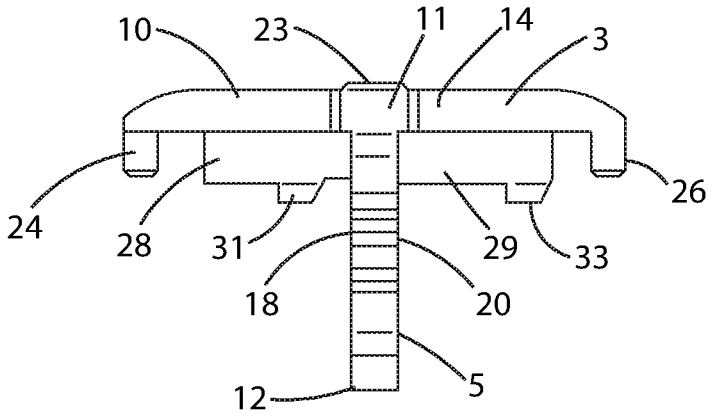
FIG. 2 is a front elevational view of the male TPA device of this invention.

As shown in FIG. 2, the flexible arm member 18 includes at least a protruding member or nub member 20. Although the number of protruding members or nub members 20 shown in FIG. 2 is two, it is not limited thereto. An upper front portion 11 of the flexible arm member 18 is, as shown in FIG. 1, at an incline. Also, a lower front portion 12 of the flexible arm member 18 is, as shown in FIG. 1, at an incline.

Further illustrated in FIG. 2 are end members 24, 26 extending substantially downward from the wing-like shape side members 10, 14, respectively. Also extending substantially downward from the wing-like shape side members 10, 14 are intermediate members 28, 29, respectively. Each intermediate member 28, 29 has a corresponding nub 31, 33, respectively, extending downward therefrom.

Figure 3:
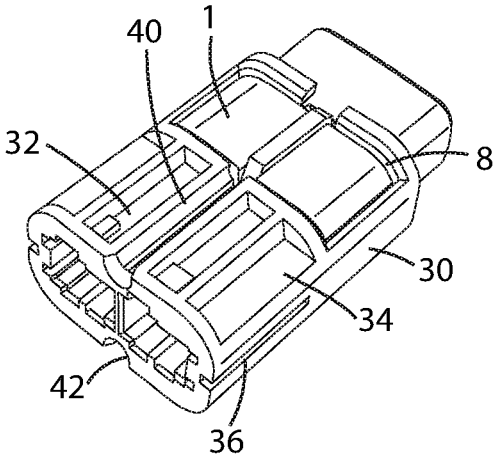
FIG. 3 is a perspective view of the male TPA device of this invention fitted or installed, in a male inner housing, at a full-lock position.

The male TPA device 1 of this invention is shown in FIG. 3 as being inserted through an opening 8 passing through an upper portion of a male inner housing 30 of a high voltage connector assembly (generally referred to as reference number 100, in FIGS. 4 and 6), and fitted or installed, in the male inner housing 30, at a full-lock position. FIG. 3 also shows fitting grooves 32, 34, 36 on the external surfaces of the inner male housing 30 for allowing the male TPA device 1 to be installed or inserted into a male outer housing 60 (see, FIGS. 4-7) of the high voltage connector assembly 100.

Figure 4:
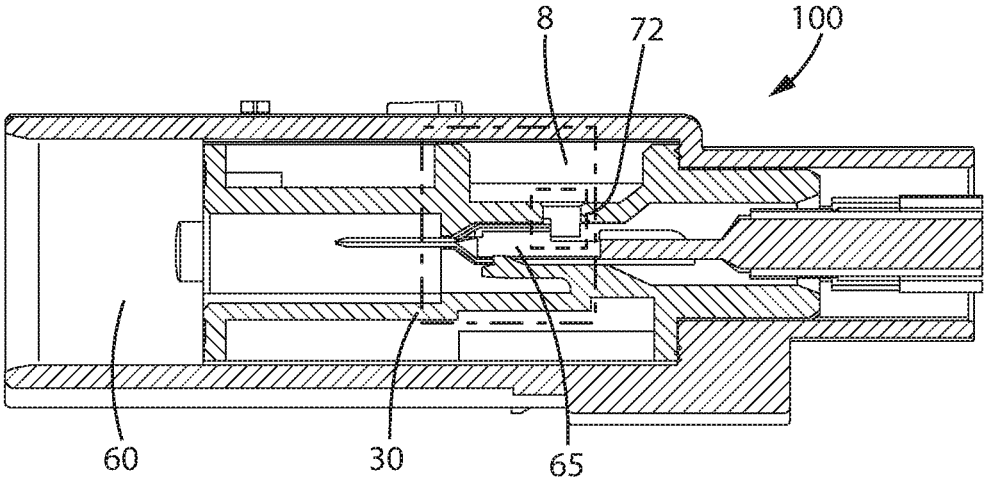
FIG. 4 is a cross-sectional view of a high voltage connector assembly having a high voltage electrical terminal inserted therein and capable of receiving the male TPA device of this invention within a TPA window, as shown in the dashed-lines isolated squared portion.

FIG. 4 is a cross-sectional view of a high voltage connector assembly having the male inner housing 30 and a male outer housing 60. The high voltage connector assembly 100 has a high voltage electrical terminal 65 inserted therein and capable of receiving the male TPA device 1 of this invention within a TPA window 72, as shown in the dashed-lines isolated squared portion.

Figure 5:
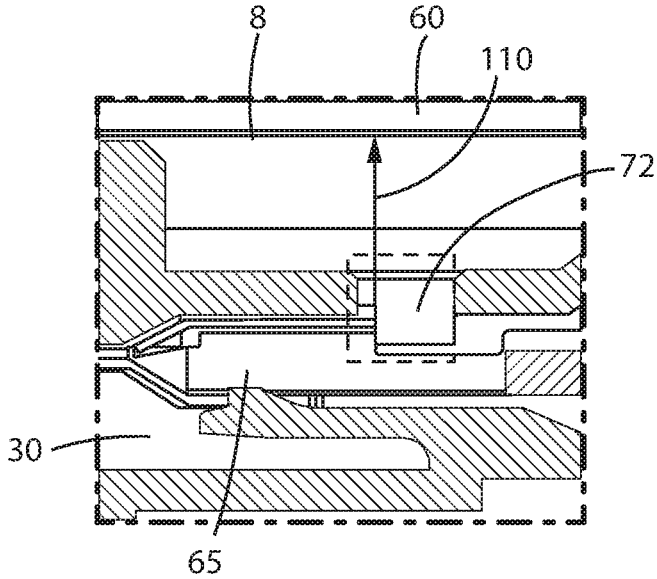
FIG. 5 is a cross-sectional view of a portion of the high voltage connector assembly, having the high voltage electrical terminal inserted therein, capable of receiving the male TPA device of this invention within the TPA window and illustrating therein a clearance for the electrical path from the high voltage electrical terminal to a male outer housing, as shown in a vertical arrow.

FIG. 5 is a cross-sectional view of a portion of the high voltage connector assembly 100, having the high voltage electrical terminal 65 inserted therein, capable of receiving the male TPA device 1 of this invention within the TPA window 72 and illustrating therein a clearance for an electrical path 110 from at least the high voltage electrical terminal 65 to the male inner housing 30 of the high voltage connector assembly 100 through the opening 8 passing through the upper portion of the male inner housing 30, and to the male outer housing 60, as shown in a vertical arrow in FIG. 5.

This invention is directed to a method for improving clearance and creepage in a high voltage connector assembly 100 using the male TPA device 1. The high voltage connector assembly 100 is highly suitable for the high voltage electrical terminals 65, which are larger terminals. The male TPA device 1 in this invention includes the wing-like shape side members 10, 14 with intermediate members 28, 29 substantially downward from the wing-like shape side members 10, 14, respectively. Each intermediate member 28, 29 has a corresponding nub 31, 33, respectively, extending downward therefrom.

With the above-described characteristics of this invention, "creepage" (a measurement of the shortest path along the surface from a circuit, here the high voltage electrical terminal 65, traveling in a direction or extending along the surface, here the surface of male TPA device 1 and male inner housing 30, to any (usually adjacent) other circuit, here an electrically conducting male outer housing 60 or a traditional stamped metal shield (not shown)), and "clearance" (a measurement of the shortest electrical path from any exposed electrically conducting element, here the high voltage electrical terminal 65, in a given circuit of a connector to any other electrically conducting element in a different circuit in the same connector, here the male outer housing 60 or a traditional stamped metal shield (not shown)) are advantageously increased.

Figure 6:
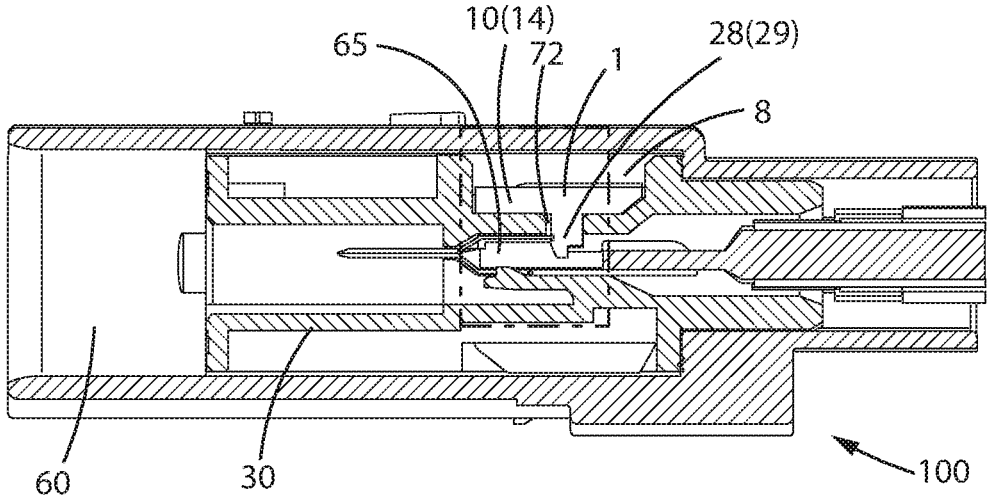
FIG. 6 is cross-sectional view of the high voltage connector assembly having the high voltage electrical terminal inserted therein and the male TPA device of this invention within the TPA window, the male TPA device being in a full-lock position.

More particularly, FIG. 6 is a cross-sectional view of the high voltage connector assembly 100 of this invention having the high voltage electrical terminal 65 inserted into the male inner housing 30, and the male TPA device 1 of this invention inserted therein in a full-lock position or orientation, the an at least one of the corresponding wing-like shape side members 10, 14 resides in the opening 8 (see also, FIG. 3), and the an at least one of the intermediate members 28, 29 thereof residing in the TPA window 72. As illustrated in FIG. 6, the intermediate member 28 is located substantially directly behind a portion of the high voltage electrical terminal 65.

Figure 7:
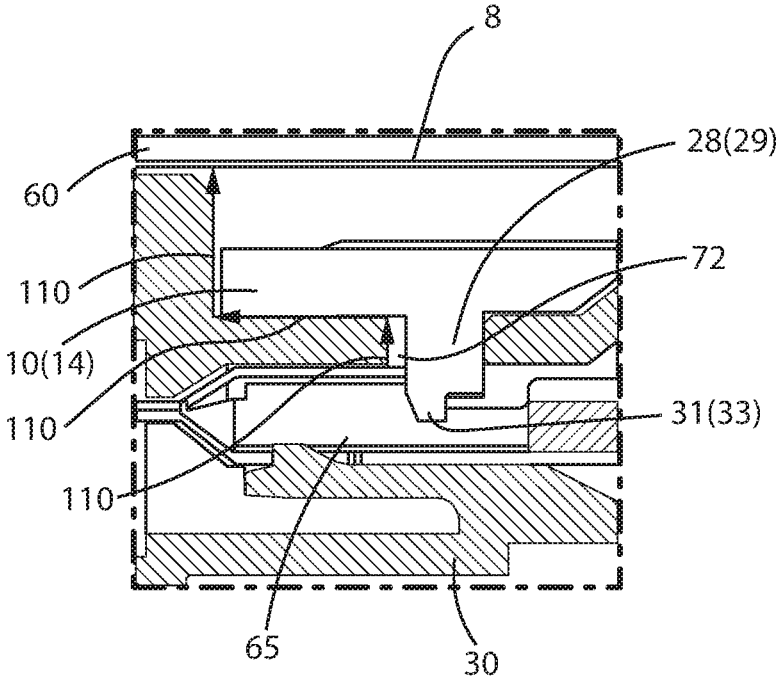
FIG. 7 is a cross-sectional view of a portion of the high voltage connector assembly having the high voltage electrical terminal inserted therein and the male TPA device of this invention within the TPA window and illustrating therein a clearance or creepage for the electrical path substantially along a surface of the male TPA device of this invention.

FIG. 7 is a cross-sectional view of a portion of the high voltage connector assembly 100 having the high voltage electrical terminal 65 inserted therein and the male TPA device 1 of this invention, and an at least one of the intermediate members 28, 29 residing in the TPA window 72 and substantially directly behind a portion of the high voltage electrical terminal 65, illustrating therein the clearance and or creepage for the electrical path 110 from at least the high voltage electrical terminal 65 substantially along an outer surface of the male TPA device 1 of this invention, traveling to the male outer housing 60. As illustrated in FIG. 7, the clearance and or creepage for the electrical path 110 extends, for example, from at least the high voltage electrical terminal 65 along or between the surface or surfaces of at least one of the intermediate members 28, 29 and the surface or surfaces of the male inner housing 30, and further along or between the surface or surfaces of an at least one of the corresponding wing-like shape side members 10, 14, and the surface or surfaces of the male inner housing 30, and yet further along the opening 8 passing through the upper portion of the male inner housing 30 and passing substantially straight, directly to, the male outer housing 60 of the high voltage connector assembly 100.

The present invention is not limited to the above-described embodiments; and various modifications in design, structural arrangement or the like may be used without departing from the scope or equivalents of the present invention.

We claim:

1. A method for improving clearance and creepage in a high voltage connector assembly using a male terminal position assurance (TPA) device, comprising the steps of:

inserting at least a terminal inside a male inner housing of said high voltage connector assembly;

locking, by using said TPA device, said terminal inside said male inner housing of said high voltage connector assembly, said TPA device having an upper member with a substantially wing-like shape having opposing sides, and at least one of intermediate members, residing in a TPA window of said male inner housing, substantially directly behind a portion of said terminal;

providing said high voltage connector assembly with a male outer housing, said male inner housing being accommodated within said male outer housing;

inserting said male TPA device through an opening of said male inner housing and locking said male TPA device into said male inner housing;

allowing a clearance or electrical path to extend from said at least terminal along or between a surface or surfaces of at least one of said intermediate members and a surface or surfaces of said male inner housing, and further along or between a surface or surfaces of an at least one of said wing-like shape side members and a surface or surfaces of said male inner housing, and yet further along an opening passing through an upper portion of said male inner housing and passing substantially straight and directly to said main outer housing of said high voltage connector assembly.

2. The method for improving clearance and creepage in said high voltage connector assembly using said male TPA device in accordance to claim 1, wherein said step of allowing said clearance or electrical path to extend substantially vertically from at least said terminal to said main outer housing.

* * * * *